US005915975A

United States Patent [19]

McGrath

[11] Patent Number: 5,915,975

[45] Date of Patent: Jun. 29, 1999

[54] SURFACE MOUNT CONNECTOR WITH INTEGRATED POWER LEADS

[75] Inventor: James L. McGrath, Bloomingdale, Ill.

[73] Assignee: Molex Incorporated, Lisle, Ill.

[21] Appl. No.: 08/712,738

[22] Filed: Sep. 12, 1996

[51] Int. Cl.[6] ..... H01R 9/09

[52] U.S. Cl. ..... 439/74; 439/108

[58] Field of Search ..... 439/74, 101, 108

[56] References Cited

U.S. PATENT DOCUMENTS

| | | | |
|---|---|---|---|
| 4,659,155 | 4/1987 | Walkup et al. | 439/108 |
| 4,762,500 | 8/1988 | Dola et al. | 439/79 |
| 5,413,491 | 5/1995 | Noschese | 439/108 |
| 5,575,686 | 11/1996 | Noschese | 439/620 |

FOREIGN PATENT DOCUMENTS

| | | | |
|---|---|---|---|
| 53-26978 | 3/1978 | Japan . | |
| 7-201401 | 8/1995 | Japan | H01R 13/514 |
| 7-326442 | 12/1995 | Japan | H01R 23/68 |

*Primary Examiner*—Neil Abrams
*Assistant Examiner*—T C Patel
*Attorney, Agent, or Firm*—Charles S. Cohen

[57] ABSTRACT

A board-to-board connector assembly includes two interengaging plug connector and receptacle connector halves with power and signal terminals integrated therein. Each of the plug and receptacle connector halves include respective dual plug and receptacle housings spaced apart from each other in a substantially parallel relationship. The dual connector housings of the plug and receptacle connector halves are evenly spaced apart by bridging pieces which extend between the connector housings to connect them together. The bridging pieces may either be integrally formed with the connector housings or they may be separately formed from the connector housings and include engagement members which engage the connector housings. The bridging pieces have power terminals disposed therein so that the connector assembly effects a connection not only between signal circuits of the circuit boards, but also between power circuits.

21 Claims, 3 Drawing Sheets

SURFACE MOUNT CONNECTOR WITH INTEGRATED POWER LEADS

BACKGROUND OF THE INVENTION

The present invention relates generally to electrical connectors, and more particularly, to an improved surface mount board-to-board connector having power leads integrated with the connector.

Board-to-board connectors for electrically connecting a pair of parallel circuit boards or members are well known in the art. These board-to-board connectors typically utilize two opposing connector components mounted to respective opposing surfaces of the circuit boards and which project away from the circuit board mounting surfaces. One of the connector components is a male member and includes a plug member, while the other of the two connector components is a female member and includes a receptacle. The male plug member fits into the female receptacle in order to connect the two circuit boards together.

Board-to-board connectors further include a series of electrical terminals disposed in the two interengaging male and female connector components which contact each other when the male member is fitted into the female receptacle. These terminals have tail portions which extend out from the bottom or sides of the connector for subsequent positioning thereof either through holes in the circuit board or for engaging a like number of electrical contact pads, or traces, formed on the surfaces of the respective circuit boards and are subsequently soldered thereto. This latter mounting method is referred to in the art as surface mounting.

The contact terminals of surface mount board-to-board connectors extend along the length of the connectors and thus, the number of circuits that a surface mount connector can accommodate is limited by the length of the connector. The trend in modern electronic devices is toward miniaturization. Space on circuit boards used in electronic devices is at a premium, and whenever space is opened up on these circuit boards, the possibility of either decreasing the size of the electronic device or adding other circuitry beneficially increase.

Heretofore, the power supplied to the various circuit boards in electronic devices has been accomplished through separate power leads. These power leads have utilized separate power connectors where two power leads are held within connector housings and engaged together. These power leads require separate connectors, and hence take up valuable space on the circuit boards of electronic devices. In the alternative, identical terminals have been utilized for both signal and power/ground. However, due to the trend towards miniaturization, many of these terminals must be utilized in order to achieve the power/ground function.

The present invention provides benefits over the prior art practice of utilizing separate circuitry and power connectors by providing a connector which has one or more power-connecting portions integrated therewith, thus permitting the consolidation of power connections into a circuitry connection, and therefore resulting in a beneficial saving of space in an electronic device circuitry board. As operating voltages of electronic devices drop, such as in computers, the operating current increases. The present invention permits the use of high density, close pitch signal terminals with printed circuit boards requiring high current.

Accordingly, it is a general object of the present invention to provide a new and improved board-to-board connector which incorporates power terminals in portions of the connector previously unutilized for connecting purposes.

Another object of the present invention to provide a new and improved board-to-board connector assembly having a male connector component and a female connector component, the male connector component having two elongated connector housing bodies interconnected at opposing ends, the female connector component having two elongated connector housing bodies interconnected at their opposing ends, the interconnection being accomplished by way of interconnecting bridging members which include power connections formed therein.

A still further object of the present invention is to provide a board-to-board surface mount connector having male and female dual interengaging connector housings, the male and female dual connector housings being interconnected by transverse spacer members, the spacer members including at least one power lead extending therefrom and at least one power receptacle disposed therein, the power lead and receptacle engaging each other in electrical contact when the male and female dual connector housings are interengaged.

SUMMARY OF THE INVENTION

The present invention is directed to a board-to-board connector which overcomes the above-mentioned shortcomings of the prior art and which offers an improvement over the prior art by integrating a power connector into a circuitry connector, thereby increasing the space available on circuit boards for either additional circuitry or for a reduction in size of the circuit board In one principal aspect of the present invention and in accordance with a first embodiment of the invention, an improved board-to-board connector assembly includes a dual plug housing assembly and a dual receptacle housing assembly. The plug housing assembly has two male connector housings disposed generally parallel to each other and joined together at the opposing ends of the housings by spacers, or bridging pieces integrally formed with the male connector housings. The receptacle housing assembly has two female connector housings disposed in a spaced-apart, parallel relationship and joined together at opposing ends by like integral spacer members that maintain the alignment of both the plug and receptacle housings for mounting purposes and also maintain the alignment of the terminal tails. One or more power leads are disposed in one set of the spacer members and include corresponding contact blades which project therefrom. These contact blade include solder tail portions extending out from the spacer members and into contact with power circuitry as a circuit board. A like number of power receptacles are disposed in the opposing spacer members and include blade-engaging contacts, also with solder tails that engage power circuitry on an opposing circuit board.

In another principal aspect of the present invention and in accordance with a second embodiment, the improved board-to-board connector assembly includes a pair of opposing male and female dual connector assemblies, each of the male and female connector assemblies having two elongated housing portions arranged in a spaced-apart, parallel fashion, with each housing portion having a plurality of electrical terminals disposed therein on opposing surfaces thereof. The electrical terminals of the male and female connector assemblies engage each other when the connector assemblies are interengaged with each housing portion having engagement members disposed on opposing ends received within recesses formed in separate spacer members having engagement means that engage opposing ends of the housing. The spacer members interconnect the housings of the male and female connector assemblies together and contain complementary, interengaging power components such that, upon mating the male and female connectors, the connector assembly not only connects signal circuitry, but also power circuits of the opposing circuit boards together.

These and other objects, features and advantages of the present invention will be clearly understood through a consideration of the following detailed description.

BRIEF DESCRIPTION OF THE DRAWINGS

In the course of the following detailed description reference will be made to the attached drawing wherein like reference numerals identify like parts and wherein.

DESCRIPTION OF THE PREFERRED EMBODIMENT

Figure 1:
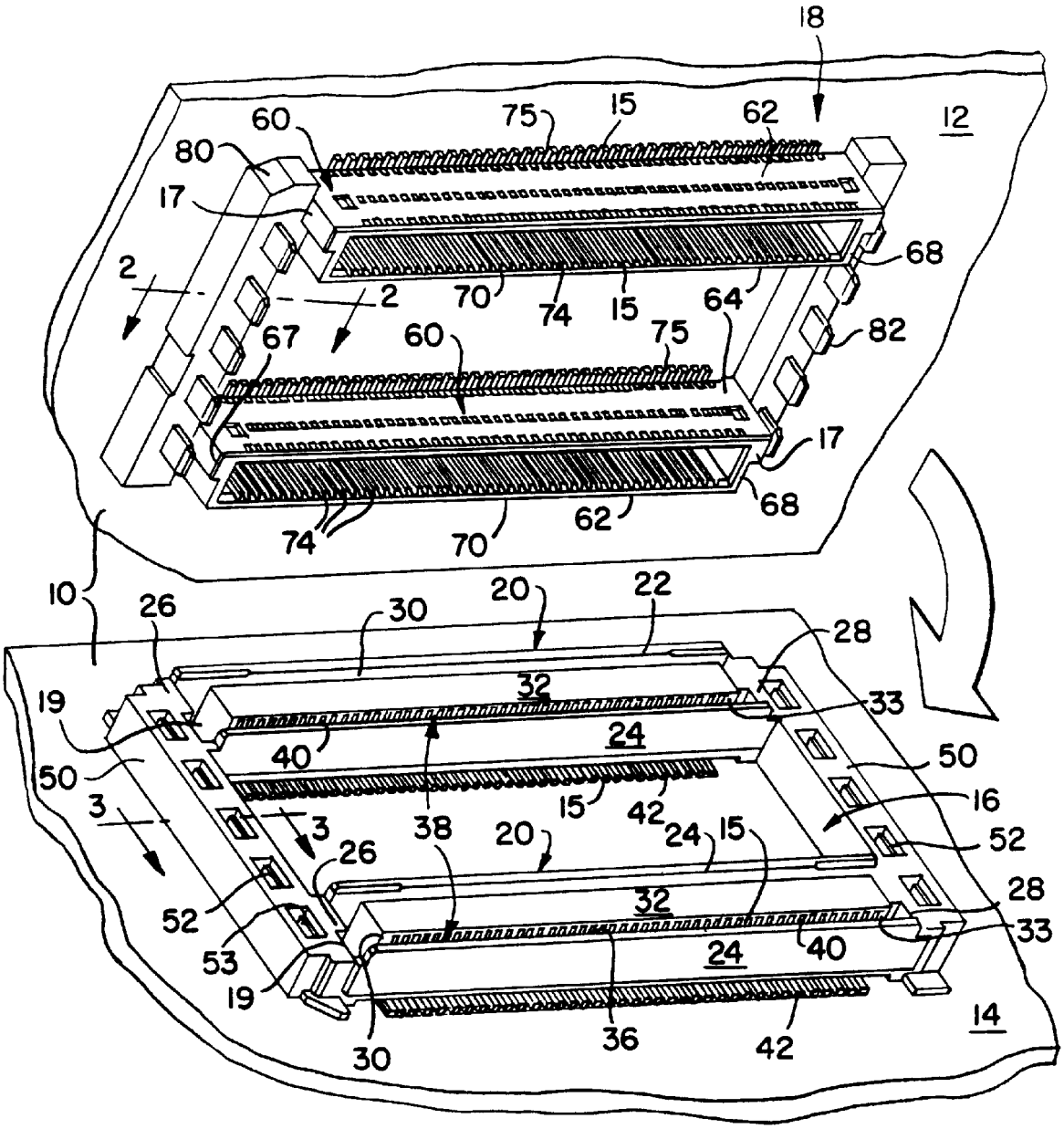
FIG. 1 is a perspective view of one embodiment of a connector assembly constructed in accordance with the principles of the present invention in place upon two opposing circuit boards.

A board-to-board connector assembly constructed in accordance with the principles of the present invention is generally designated at 10 in FIG. 1 and, as illustrated, is shown to interconnect a first circuit board 12 with an opposing, second generally parallel circuit board 14. The two circuit boards 12, 14 may be primary circuit boards for an electronic device, or they may be modular circuit boards containing increased performance circuitry.

The connector assembly 10 includes a plurality of electrical terminals, generally indicated at 15, which extend out from two opposing connector component assemblies 16 and 18 and which provide a means for connecting the connector component assemblies 16, 18 to a plurality of corresponding circuit board contact pads, or traces (not shown) on respective opposing circuit boards 12, 14 in order to connect the circuits on one board 12 to their corresponding counterpart circuits on the other board 14.

One connector component 16 is illustrated as a female connector assembly while the other connector component assembly 18 is illustrated as a male connector assembly. As is known in the art, portions of the male connector assembly 18 are received within portions of the female connector assembly 16 in order to effect a reliable connection between the two connector assemblies 16, 18.

Figure 5:
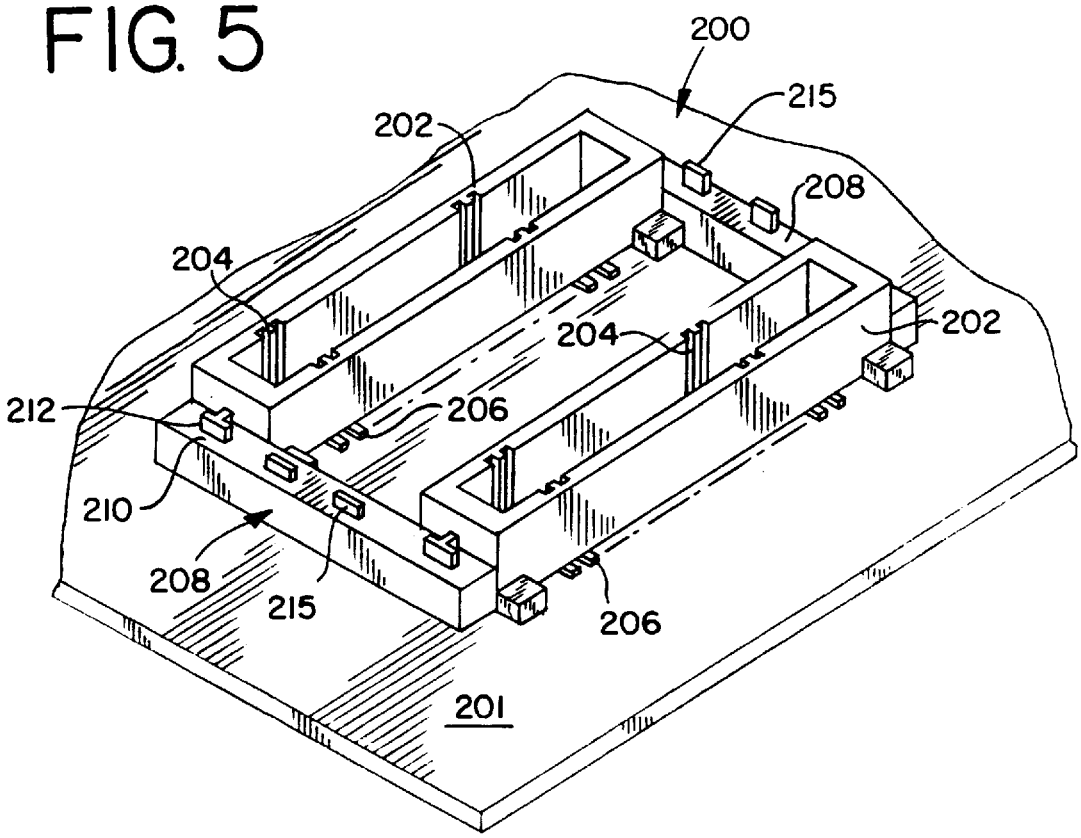

It can be seen that the female connector assembly 16 of the overall connector 10 of the present invention includes a pair of elongated female housing members 20 having opposing sidewalls 22, 24 and endwalls 26, 28 which cooperate to define an interior opening, or receptacle 30. Each housing member 20 preferably includes an interior pedestal 32 having generally the same height as the sidewalls 22, 24. (FIGS. 1 & 5.) The pedestal 32, as illustrated, has a generally elongated rectangular, or box-like shape, and is spaced apart from the housing sidewalls 22, 24 and endwalls 26, 28 by a predetermined distance to define an interior channel, or space 36, that surrounds the pedestal 32 of each female housing member 20 and that receives plug portions of their opposing associated male housings members 60 as is known in the art.

Each female housing member 20 further contains a plurality of electrically conductive terminals 38 disposed therewithin and extending outwardly therefrom. The terminals 38 include contact portions 40 which are disposed along the interior surfaces 33 of the pedestal 32 and tail portions 42 which extend outwardly from the female housing member 20. The terminal tail portions 42 penetrate through bases of the female housing members 20 and extend outwardly adjacent the bottom or side surfaces thereof for engagement with contact traces (not shown) on the circuit board 14. The terminals 38 preferably are of a high density or close pitch.

As illustrated in FIG. 1, the dual female housing members 20 are interconnected at their opposite ends by spacer or bridging members 50 which extend for approximately the full width of the housings 20 between the outermost sidewalls 22 thereof. The spacer members 50 are preferably identical in shape with each other and preferably include mounting posts 54 which extend downwardly as shown in FIG. 3 and are received in appropriately sized openings (not shown) formed in the circuit board 14 to accurately position the connector assembly 16 on the circuit board.

The spacer members 50 maintain the two female housings 20 in a spaced-apart generally parallel relationship and are formed from the same material as housings 20 such as a conventional insulative, dielectric material like plastic and preferably a high-temperature material such as liquid crystal polymer (LCP).

Figure 3:
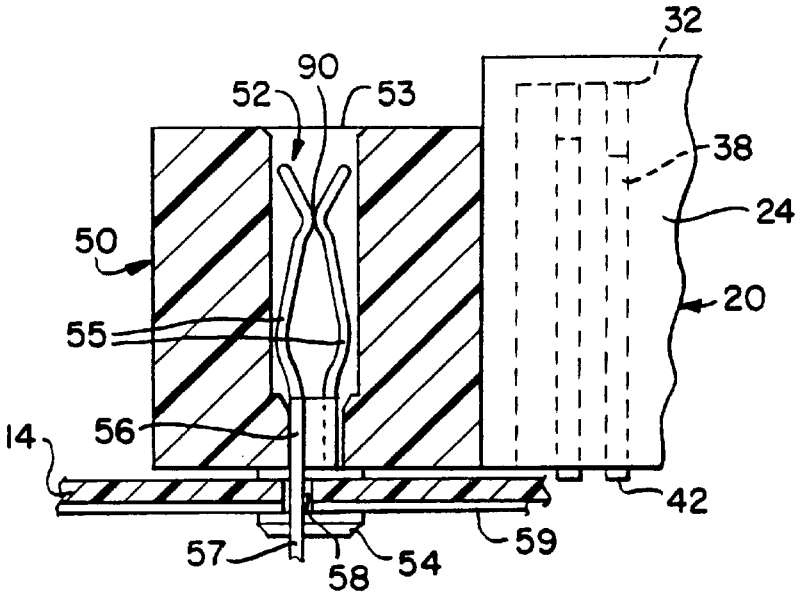
FIG. 3 is a cross-sectional view of another spacer member of the other connector component of the connector assembly of FIG. 1 taken along lines 3—3 thereof and illustrating the power contact blade-engaging receptacle.

In an important aspect of the present invention, the spacer members 50 have integrated therewith electrically conductive power terminals, illustrated in FIGS. 1 and 3 as blade-engaging contacts 52. Locating the power terminals in the spacer portions of the connector assembly allows for the use of high density, close pitch signal terminals with printed circuit board modules requiring high current. The blade-engaging contacts 52 are disposed in cavities 53 formed in the body of the spacer members 50 and include opposing contact portions 55 interconnected together at body portions 56 which terminate in tail portions 57 that extend through corresponding openings 58 formed in the circuit board 14. The openings 58 are adjacent to power circuit leads 59 formed on the circuit board and are connected thereto by conventional soldering. The contact portions 55 of the blade contacts 52 may be configured to have particular engagement surfaces 90 formed thereon which resiliently engage a mating power terminal 82 of the opposing connector assembly 18 to ensure reliable electrical contact.

Figure 2:
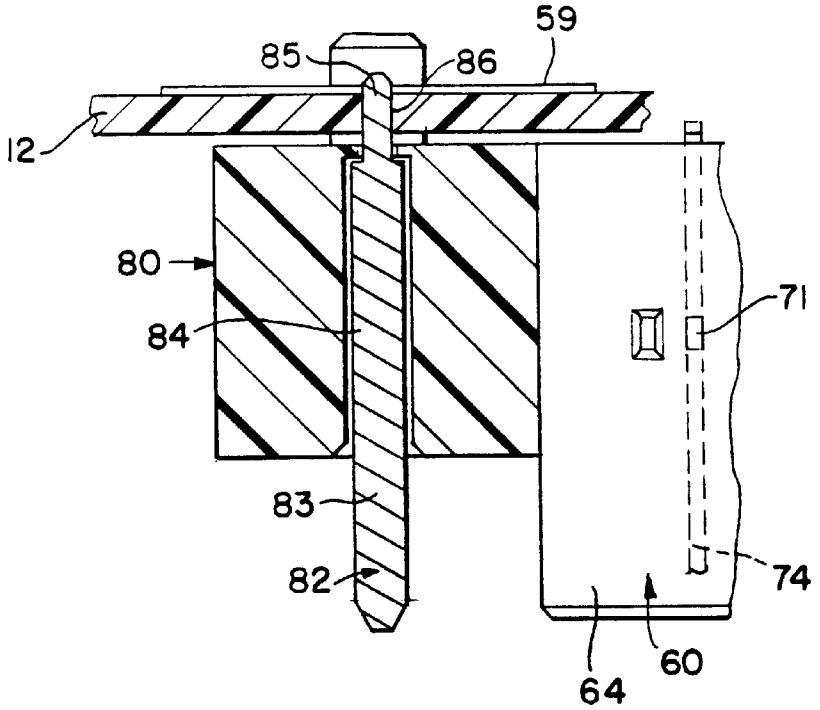
FIG. 2 is a cross-sectional view of one of the spacer members of one connector component of the connector assembly of FIG. 1 taken along lines 2—2 thereof and illustrating the power contact blade.

The blade-engaging contacts 52 may be inserted into the spacer member cavities 53 after molding thereof as is known in the art or they may be inserted into a spacer member mold and the spacer member 50 molded around them, also as known in the art. As illustrated in the embodiment of FIGS. 1–3, the spacers 50 may be integrally formed with the housings 20 so that the resulting female connector assembly 16 constitutes a unitary structure or, as described below with respect to FIGS. 5 and 6, may be separate members.

In instances where the spacer members 50 are integrally formed with the female housing members 20, the endwalls 26, 28 of the receptacles 30 abut the spacer members 50 and may be offset as illustrated in FIG. 1 to provide a polarizing means, shown as notches 19 which receive like-shaped protrusions 17 from counterpart male housing members 60 in order to ensure a proper orientation between the circuits of the two circuit boards 12 and 14.

The male connector assembly 18 includes two elongated male housing members 60, each having a pair of protruding plugs, shown as elongated wall portions 62, 64 interconnected to a pair of endwalls 67, 68 at opposing ends to define an overall rectangular plug associated with each male housing member. The endwalls 67, 68 provide reinforcement to the relatively thin plug walls 62, 64 and further define the polarizing means as described above.

The protruding wall portions 62, 64 of the male housing members define plugs that are received with the female housing member receptacle channels 36. In this regard, each such protruding wall portion 62, 64 contains a plurality of spaced-apart cavities 70 formed in the inner surfaces of the projecting walls 62, 64 which receive a like number of electrically conductive terminals 74 therein. The terminals 74 include tail portions 75 which extend outwardly from the housings 60 for engagement with contact traces (not shown) of the circuit board 12. In order to facilitate insertion and ensure reliable contact between pairs of opposing terminals, the thickness of the protruding walls or plugs is slightly less than the width of the female housing member channels 36 so that the plug terminals will reliably engage the female housing member terminals within the receptacle channels 36.

The terminals of both of the housing members are preferably formed from a highly conductive material, such as a phosphor bronze alloy and may be gold-,plated. The terminals may be set in the connector housing members by insert molding, i.e., positioning the terminals within a mold cavity and injecting plastic around them. In this regard, the housing members may include openings 71 in their appropriate sidewalls 62, 64 (FIG. 2) by which the terminals 74 may be held in the mold cavity during manufacture.

The male housing members 60 also include spacer, or bridging members 80, located proximate to the endwalls 67, 68 of the housings 60. The spacer members 80 extend for approximately the width of the male connector assembly 18 (FIG. 6) and, as illustrated in FIG. 2 accommodate one or more power terminals including contact blades 82. The contact blades 82 have solid and wide body portions 83 which are received within cavities 84 of the spacer member body portions. Tail portions 85 extend through the base of the spacer members 80 as shown and are received within openings 86 of the circuit board 12 where they are connected to power circuits 59 in a customary fashion, such as by soldering. The contact blades 82 preferably have a length (or height) that corresponds to the depth of the spacer member cavities 53 and is sufficient to project into reliable engagement with the blade-engaging contacts 52 of the female component 20.

Figure 4:
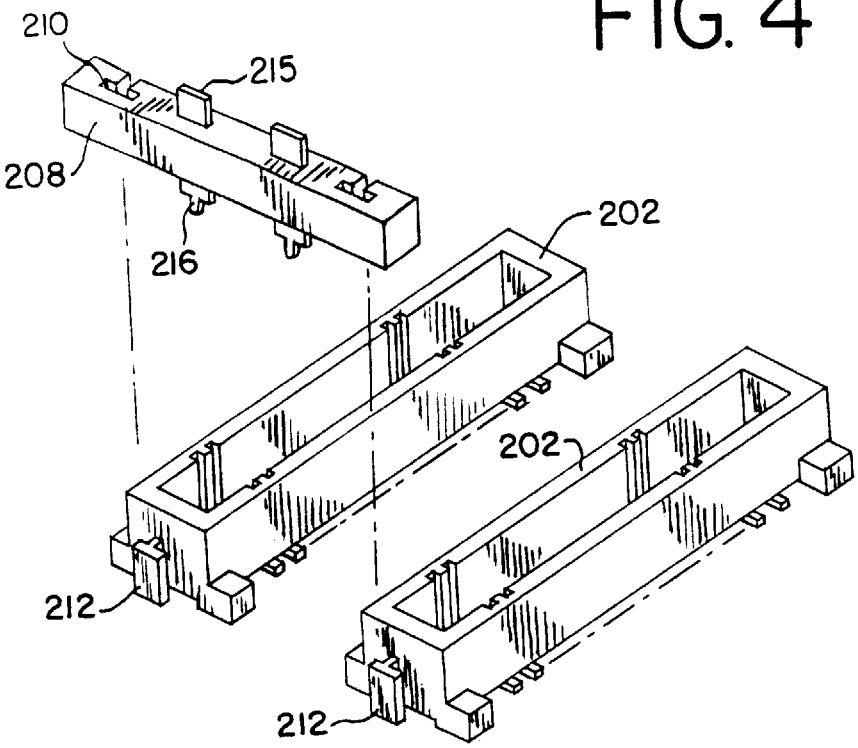
FIG. 4 is a perspective view of another embodiment of a connector assembly constructed in accordance with the principles of the present invention wherein the spacer members which carry the power leads are formed separately from the circuitry connector housings and illustrated in place on a circuit board; and, FIG. 5 is a perspective exploded view of the connector assembly of FIG. 4 illustrating how the spacer members interengage with their associated connector housings.

As shown in FIGS. 1–3, the spacer members 50, 80 may be integrally formed with their corresponding associated circuit connector housings to form two unitary assemblies 16, 18 which interengage each other. However, the spacer members which include the power connecting components may also be separately formed as shown in the assembly 200 of FIGS. 4 and 5 , it can be seen that the connector assembly 200 includes two male or plug connector components 202, each of which contains a plurality of conductive terminals 204 with corresponding soldering tails 206. The connector components 202 are interconnected by separate spacer 208 which have engagement means, such as the T-shaped slots 210 illustrated that receive corresponding T-shaped engagement lugs 212 extending from the endwalls of the connector components 202. Other than the separate spacer 208, connector assembly 200 is identical to component 18.

Finally, although the blades 82 of the power contacts are shown with their planes generally parallel to the axes of spacer members 80, they could be rotated 90° so that their planes are generally perpendicular to the axes of spacer members 80. Of course, the blade engaging contacts 52 would also be rotated 90°.

While the particular embodiments of the invention have been described above, it will be apparent to those skilled in the art that changes and modifications may be made therein without departing from the invention in its broader aspects, and, therefore, the aim of the appended claims is to cover all such changes and modifications as fall within the true spirit and scope of the invention.

I claim:

1. A board-to-board connector assembly for interconnecting a pair of spaced apart, generally parallel circuit members, the assembly comprising: interengageable plug connector and receptacle connector components, the plug connector component including a pair of plug connector housings extending in a first direction and arranged in a spaced-apart relationship and being interconnected at opposite ends by first bridging portions of generally equal length that extend in a second direction that is different than the first direction, the receptacle connector component including a pair of receptacle connector housings, also extending in said first direction and arranged in a spaced-apart relationship and being interconnected by second bridging portions of generally equal length that extend in the second direction, said plug and receptacle component housings each including a first set of electrically conductive terminals secured therein, each terminal of the first terminal set having a corresponding tail portion for interconnection to a respective circuit of one of said circuit members, and the first and second bridging portions only including a second set of electrically conductive terminals, the second terminal set including at least one pair of complementary interengaging power terminals, the pair of power terminals including at least one contact blade extending from one of said first and second bridging portions and at least one corresponding power terminal receptacle disposed only in another of said first and second bridging portions which opposes said one bridging portion, the power terminal receptacle including a contact blade-engaging terminal disposed therein, whereby upon mating said plug and receptacle components, said terminal of said plug and receptacle components engage each other and said contact blade and contact blade-engaging terminals engage each other to thereby transmit electrical power between opposing circuit boards, said first and second terminal sets being respectively isolated from each other in different portions of said connector assembly so as to save space on said plug and receptacle connector housings.

2. The connector assembly as defined in claim 1, wherein said first and second bridging portions are integrally formed with said plug and receptacle connector housings to define respective unitary, one-piece plug and receptacle connector components.

3. The connector assembly as defined in claim 1, wherein said first and second bridging portions are formed separately from said plug and receptacle connector housings and said first and second bridging pieces include means for engaging said plug and receptacle connector housings.

4. The connector assembly as defined in claim 3, wherein said engagement means include notches formed in said first and second bridging portions which receive engagement members disposed on said plug and receptacle connector housings.

5. The connector assembly as defined in claim 1, further including means for polarizing said plug and receptacle connector components to ensure said plug connector housings engage said receptacle connector housings in a predetermined orientation and so that said power terminals engage each other.

6. The connector assembly as defined in claim 5, wherein said polarizing means includes slots formed in at least one of said plug and receptacle connector housings which receive posts extending from the other of said two plug and receptacle connector housings.

7. The connector assembly as defined in claim 1, wherein said power terminal blade-engaging contact includes a pair of spring arms interconnected by a body portion.

8. A board-to-board connector assembly for providing an electrical connection between electrical circuits disposed on first and second opposing, spaced-apart circuit members, the connector assembly comprising:

a plug connector component adapted for mounting to a surface of the first circuit member and a receptacle connector component adapted for mounting to a surface of the second circuit member, the plug connector component being adapted for engagement with the receptacle connector component, the plug connector component including a pair of spaced apart, elongated plug connector housings extending in a first direction and interconnected together at ends thereof by elongated plug bridging pieces extending in a second direction that is angularly disposed with respect to the first direction, the plug bridging pieces spacing the plug connector housings apart, the elongated plug bridging pieces having a length substantially less than the elongated plug connector housing, the receptacle connector component including a pair of spaced apart, receptacle connector housings extending in said first direction and interconnected together at ends thereof by elongated receptacle bridging pieces extending in said second direction and spacing the receptacle connector housings apart, the elongated receptacle bridging pieces having a length substantially less than the elongated receptacle connector housing, said receptacle connector housings having engagement cavities and a plurality of receptacle terminals associated therewith, the receptacle terminals being disposed only on said receptacle connector housings within said engagement cavities and having tail portions extending out from said receptacle connector housings, and being adapted to engage circuit traces on the surface of said second circuit member, said plug connector housings having a plurality of plug terminals associated therewith that are disposed only on plug connector housings, said plug connector housings further having plug portions protruding therefrom, the plug terminals being disposed along the protruding plug portions and having tail portions extending out from said plug connector housings and being adapted to engage circuit traces on the surface of said first circuit member, one of receptacle and plug bridging pieces having a plurality of spaced apart, first power terminals that are disposed only on said one of said plug and receptacle bridging pieces and another of said receptacle and plug bridging pieces having a plurality of spaced apart, second power terminals that are disposed only on said another of said receptacle and plug bridging pieces, said first and second power terminals being aligned with each other and disposed only on said one and another bridging pieces so as to save space on said receptacle and plug connector housings, such that upon mating of said plug and receptacle connector housings, said first power terminals mate with respective ones of said second power terminals, said first power terminals being substantially wider than said plug and receptacle terminals in order to carry a greater amount of current.

9. The connector assembly as defined in claim 8, wherein said plug bridging pieces and said receptacle bridging pieces are respectively integrally formed with said plug connector housings and said receptacle connector housings such that said plug connector housings and bridging pieces constitute a one-piece plug connector component and said receptacle connector housings and bridging pieces constitute a one-piece receptacle connector component.

10. The connector assembly as defined in claim 8, wherein said plug and receptacle bridging pieces include separate, elongated body portions which include means for engaging respective ones of said plug connector and receptacle connector housings.

11. The connector assembly as defined in claim 8, wherein said plug and receptacle bridging pieces respectively interconnect said plug and receptacle connector housings together at opposing ends of said plug and receptacle connector housings.

12. The connector assembly as defined in claim 8, wherein said first power terminal includes an elongated contact blade extending from said one bridging piece, the contact blade having a body portion disposed within said one bridging piece, and the contact blade further having a tail portion the contact blade being oriented in said first direction and said plug terminals being oriented in said first direction.

13. The connector assembly as defined in claim 12, wherein said first power terminal tail portions and said contact blades extend in opposite directions from said one bridging piece.

14. The connector assembly as defined in claim 8, wherein said another bridging piece includes a cavity and said second power terminal includes a spring contact having an engagement portion disposed within said another bridging piece cavity.

15. The connector assembly as defined in claim 14, wherein said spring contact further includes a tail portion, the tail portion extending away from said another bridging piece.

16. A connector component for mating with a second, complementary connector component in order to interconnect a pair of spaced apart, generally parallel circuit members, the second connector component including a pair of elongated, generally parallel second connector housings arranged in a spaced-apart relationship in a first direction and a pair of spaced apart, elongated second bridging members of generally equal length extending in a second direction that is different from the first direction, the second bridging members interconnecting said second connector housings at opposite ends thereof, said second bridging members having a length substantially less than the second connector housings, said second connector housings having a first set of conductive contacts spaced apart therealong that are adapted to conduct electrical signals therealong, said second bridging members having a second set of conductive contacts spaced apart therealong that are adapted to conduct electrical power therealong, said connector component comprising:

a pair of elongated, generally parallel connector housings arranged in a spaced-apart relationship and extending in a first direction, a pair of spaced apart, elongated bridging members of generally equal length extending in a second direction that is offset from said first direction, the bridging members interconnecting said connector housings at opposite ends thereof, said bridging members having a length substantially less than the connector housings, said connector housings having a first set of conductive signal-carrying contacts spaced apart therealong and adapted for mating with said second connector component first set of contacts, said bridging members having a second set of conductive, power-carrying contacts type spaced apart therealong and adapted for mating with said second connector contact set, said second contact set being substantially wider than said first contact set in order to facilitate carrying a greater amount of current, said first contact set being disposed only on said connector housings and said second contact set being disposed only on said bridging pieces so as to save space on said connector housings.

17. The connector as defined in claim 16, wherein said first type of terminals includes surface mount tails for soldering to circuitry on the surface of one of said circuit members and said second type of terminals includes through hole solder tails for interconnection to circuitry in holes in one of said circuit members.

18. The connector as defined in claim 16, wherein said bridging members are integrally formed with their respective connector housings to define one-piece connector structures of said connector and second component, respectively.

19. The connector as defined in claim 16, wherein said bridging members are formed separately from their respective connector housings and said bridging members include means for engaging their respective connector housings.

20. The connector as defined in claim 19, wherein said engagement means include notches formed in said bridging members which receive engagement members disposed on said connector housings.

21. A connector component, comprising:

a pair of elongated connector housings formed from an electrically insulative material, the connector housings each having a mounting surface for mounting to a circuit member, and a mating surface for mating with an opposing connector component, said connector housings each having a length extending in a first direction;

said connector housings being spaced apart from each other a preselected distance by a pair of elongated bridging members that extend in a second direction that is offset from said first direction, each of the bridging members having a mounting surface for mounting to the circuit member and a mating surface for mating with the opposing connector component;

a plurality of first electrically conductive terminals disposed only on said connector component connector housings and adapted to carry electrical signals of a first type from said circuit member to said opposing connector component and vice-versa; and, at least one second electrically conductive terminal disposed only on said bridging members of said connector component so as to save space on said connector component connector housings, whereby said first and second conductive terminals are isolated from each other in different portions of said connector component.

* * * * *